US010910696B2

(12) United States Patent
Chang et al.

(10) Patent No.: US 10,910,696 B2
(45) Date of Patent: Feb. 2, 2021

(54) MOBILE DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 16/550,681

(22) Filed: Aug. 26, 2019

(65) Prior Publication Data

US 2021/0005952 A1 Jan. 7, 2021

(30) Foreign Application Priority Data

Jul. 5, 2019 (TW) ..... 108123737 A

(51) Int. Cl.
*H01Q 1/22* (2006.01)
*H01Q 9/42* (2006.01)

(52) U.S. Cl.
CPC ..... *H01Q 1/2291* (2013.01); *H01Q 9/42* (2013.01)

(58) Field of Classification Search
CPC .. H01Q 1/16; H01Q 1/38; H01Q 1/48; H01Q 1/243; H01Q 1/2291; H01Q 5/385; H01Q 9/42; H04M 1/26
See application file for complete search history.

(56) References Cited

U.S. PATENT DOCUMENTS 10,629,990 B2 4/2020 Lee et al.
2015/0123871 A1* 5/2015 Chang ..... H01Q 1/243 343/872
2016/0315373 A1* 10/2016 Azad ..... H01Q 1/48
2017/0207542 A1* 7/2017 Tseng ..... H01Q 13/106
2017/0331187 A1* 11/2017 Huang ..... H01Q 1/2291
2019/0006766 A1* 1/2019 Yonei ..... H01Q 13/16
2019/0027811 A1* 1/2019 Chen ..... H04M 1/26
2019/0221943 A1* 7/2019 Wu ..... H01Q 13/106

FOREIGN PATENT DOCUMENTS

TW 201814965 A 4/2018

OTHER PUBLICATIONS

Chinese language office action dated Feb. 24, 2020, issued in application No. TW 108123737.

* cited by examiner

*Primary Examiner* — Ganiyu A Hanidu
(74) *Attorney, Agent, or Firm* — McClure, Qualey & Rodack, LLP

(57) ABSTRACT

A mobile device includes a metal mechanism element, a feeding radiation element, a first radiation element, a second radiation element, and a dielectric substrate. The metal mechanism element has a slot. The slot has an open end and a closed end. The feeding radiation element has a feeding point. The first radiation element extends across the slot of the metal mechanism element. The feeding radiation element is coupled through the first radiation element to a ground voltage. The second radiation element is coupled to the feeding radiation element. The dielectric substrate is adjacent to the metal mechanism element. The feeding radiation element, the first radiation element, and the second radiation element are disposed on the dielectric substrate. An antenna structure is formed by the feeding radiation element, the first radiation element, the second radiation element, and the slot of the metal mechanism element.

15 Claims, 6 Drawing Sheets

MOBILE DEVICE

CROSS REFERENCE TO RELATED APPLICATIONS

This application claims priority of Taiwan Patent Application No. 108123737 filed on Jul. 5, 2019, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to a mobile device which includes a metal mechanism element, a feeding radiation element, a first radiation element, a second radiation element, and a dielectric substrate. The metal mechanism element has a slot. The slot has an open end and a closed end. The feeding radiation element has a feeding point. The first radiation element extends across the slot of the metal mechanism element. The feeding radiation element is coupled through the first radiation element to a ground voltage. The second radiation element is coupled to the feeding radiation element. The dielectric substrate is adjacent to the metal mechanism element. The feeding radiation element, the first radiation element, and the second radiation element are disposed on the dielectric substrate. An antenna structure is formed by the feeding radiation element, the first radiation element, the second radiation element, and the slot of the metal mechanism element.

In some embodiments, the feeding radiation element substantially has a straight-line shape.

In some embodiments, the first radiation element substantially has an L-shape.

In some embodiments, the second radiation element substantially has a straight-line shape.

In some embodiments, the feeding radiation element has a first end and a second end. The feeding point is positioned at the first end of the feeding radiation element.

In some embodiments, the first radiation element has a first end and a second end. The first end of the first radiation element is coupled to the ground voltage. The second end of the first radiation element is coupled to the second end of the feeding radiation element.

In some embodiments, the second radiation element has a first end and a second end. The first end of the second radiation element is coupled to the second end of the feeding radiation element. The second end of the second radiation element is an open end.

In some embodiments, the antenna structure covers a first frequency band and a second frequency band. The first frequency band is from 2400 MHz to 2500 MHz. The second frequency band is from 5150 MHz to 5850 MHz.

In some embodiments, the length of the slot is substantially equal to 0.25 wavelength of the first frequency band.

In some embodiments, the height of the antenna structure is shorter than or equal to 6 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
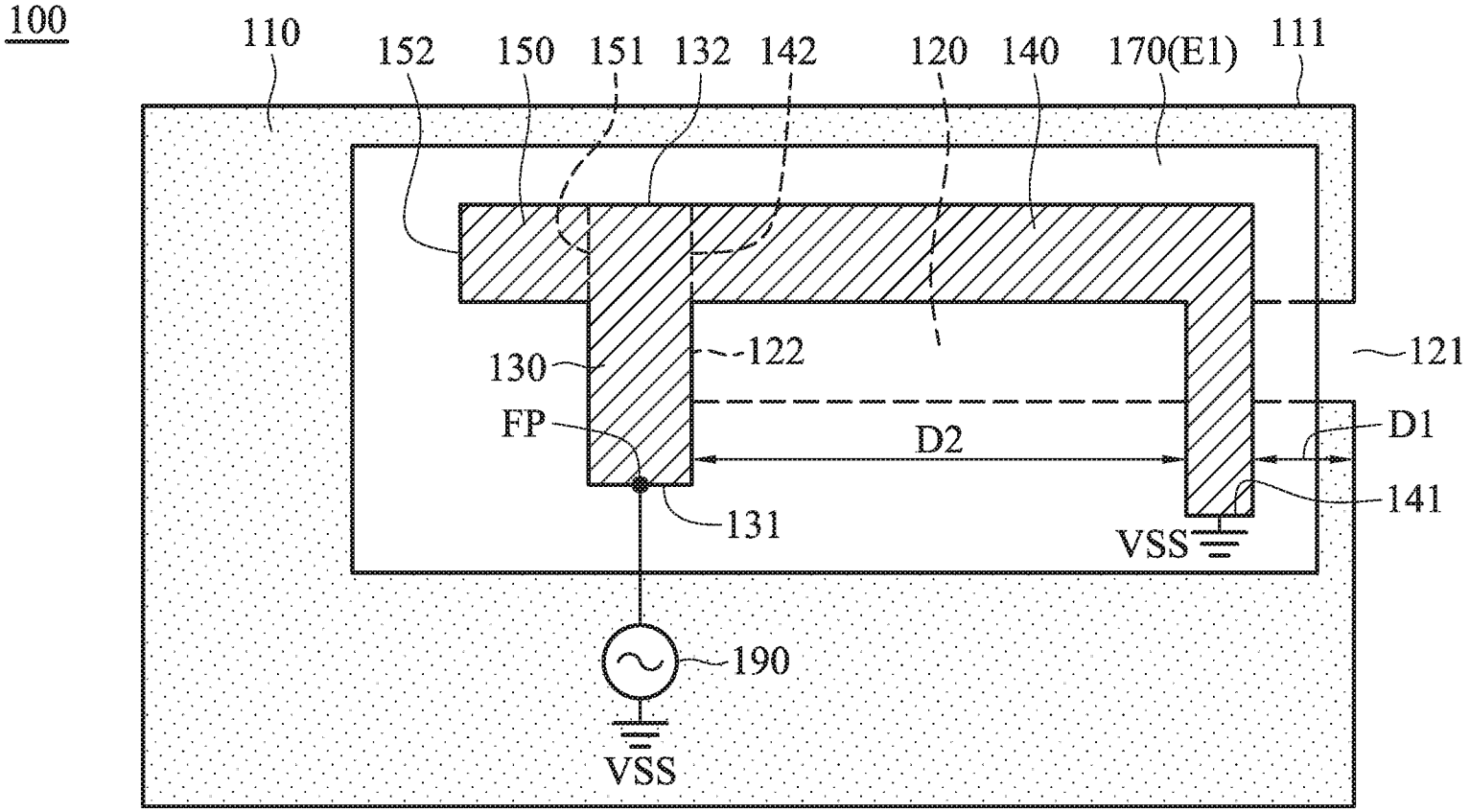
FIG. 1 is a see-through view of a mobile device according to an embodiment of the invention.
Figure 2:
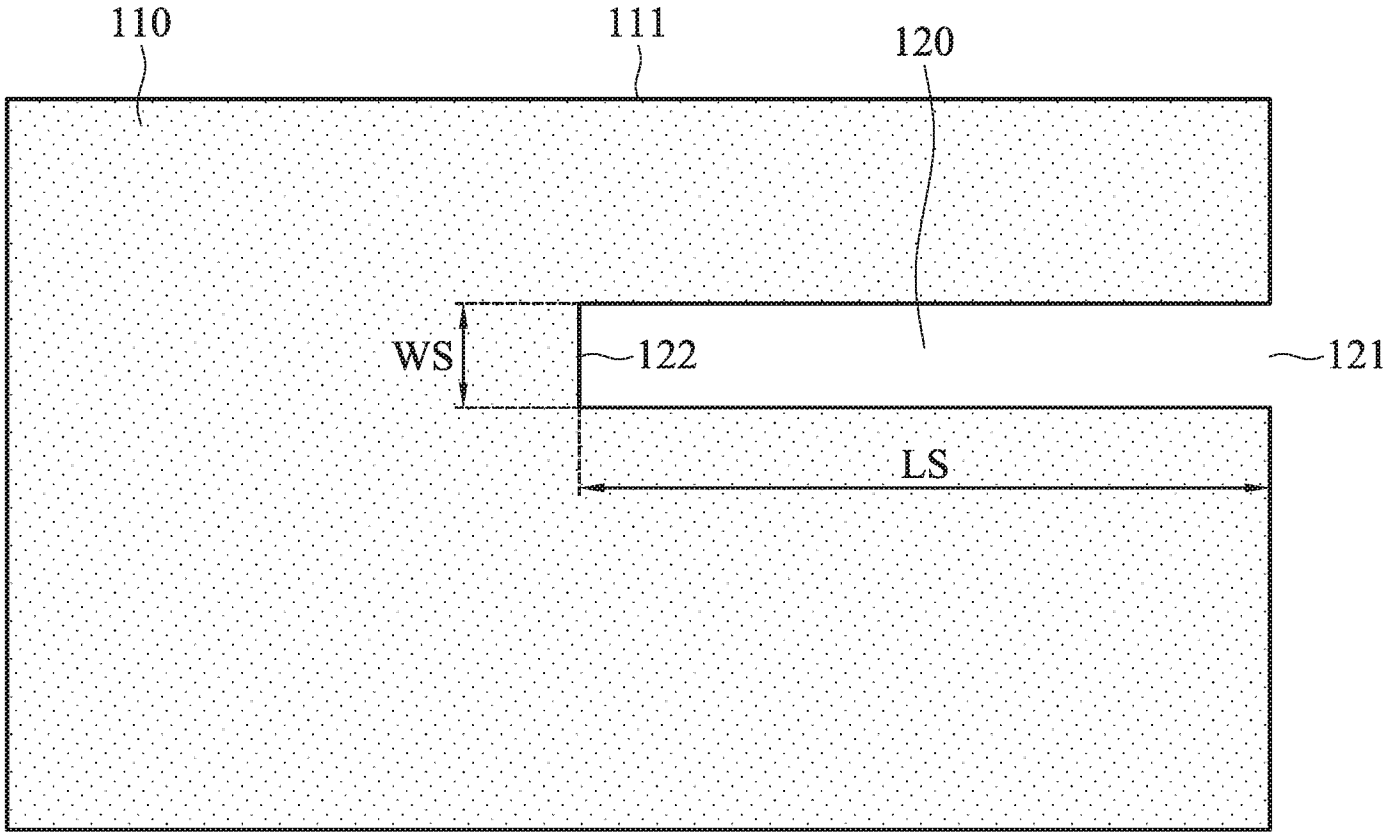
FIG. 2 is a view of a bottom-layer portion of a mobile device according to an embodiment of the invention.
Figure 3:
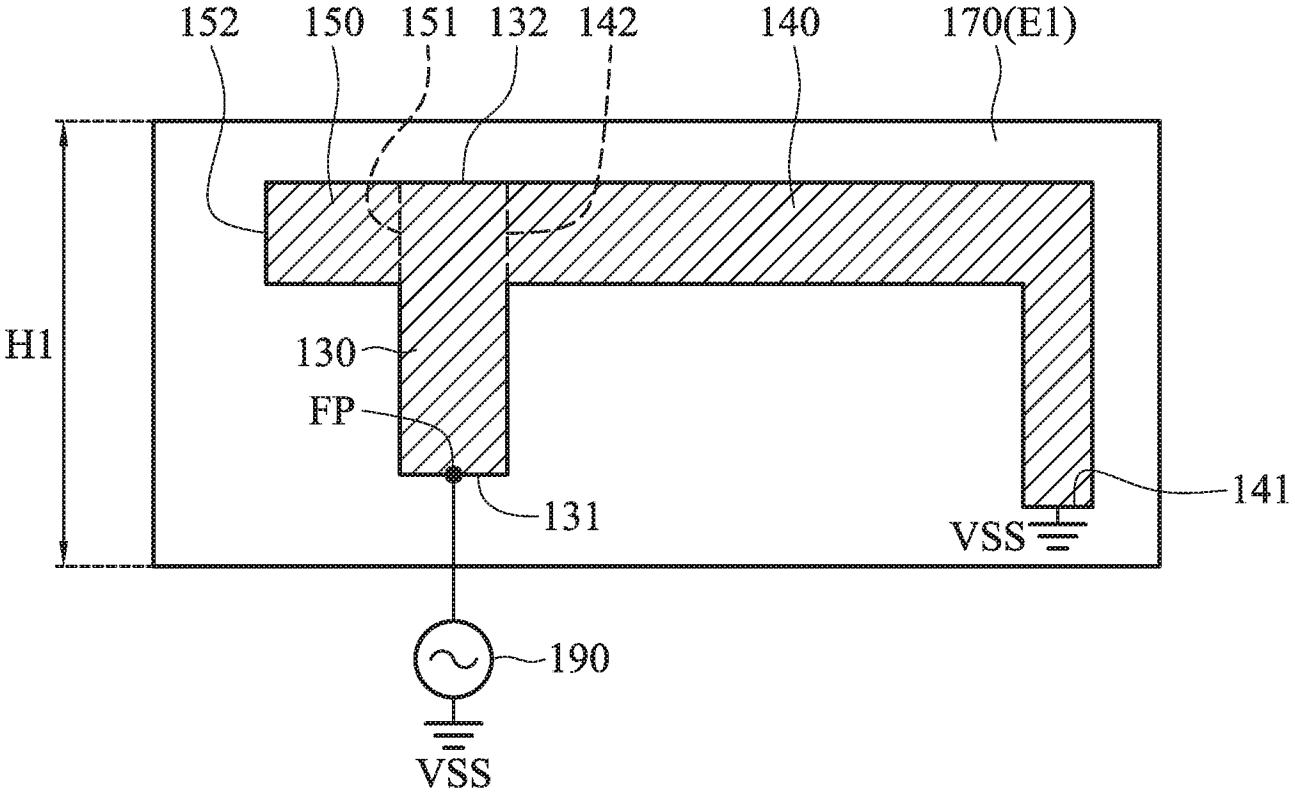
FIG. 3 is a view of a top-layer portion of a mobile device according to an embodiment of the invention.
Figure 4:
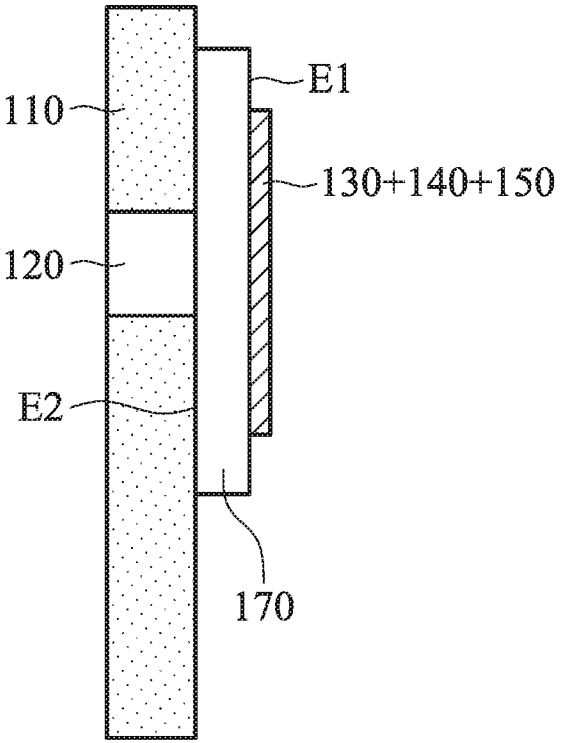
FIG. 4 is a side view of a mobile device according to an embodiment of the invention.

FIG. 1 is a see-through view of a mobile device 100 according to an embodiment of the invention. FIG. 2 is a view of a bottom-layer portion of the mobile device 100 according to an embodiment of the invention. FIG. 3 is a view of a top-layer portion of the mobile device 100 according to an embodiment of the invention. FIG. 4 is a side view of the mobile device 100 according to an embodiment of the invention. Please refer to FIG. 1, FIG. 2, FIG. 3 and FIG. 4 together. The mobile device 100 may be a smartphone, a tablet computer, or a notebook computer. In the embodiment of FIG. 1, FIG. 2, FIG. 3 and FIG. 4, the mobile device 100 includes a metal mechanism element 110, a feeding radiation element 130, a first radiation element 140, a second radiation element 150, and a dielectric substrate 170. It should be understood that the mobile device 100 may further include other components, such as a processor, a touch control panel, a speaker, a battery module, and a housing, although they are not displayed in FIG. 1, FIG. 2, FIG. 3 and FIG. 4.

The metal mechanism element 110 may be an appearance element of the mobile device 100. It should be noted that the so-called "appearance element" over the disclosure means a portion of the mobile device 100 which a user's eyes can directly observe. In some embodiments, the metal mechanism element 110 is a metal top cover of a notebook computer or a metal back cover of a tablet computer, but it is not limited thereto. For example, if the mobile device 100 is a notebook computer, the metal mechanism element 110 may be "A-component" in the field of notebook computers. The metal mechanism element 110 has a slot 120. The slot 120 of the metal mechanism element 110 may substantially have a straight-line shape. The slot 120 may be substantially parallel to an edge 111 of the metal mechanism element 110. Specifically, the slot 120 is an open slot, and the open slot has an open end 121 and a closed end 122 which are far away from each other. The mobile device 100 may further include a nonconductive material, which fills the slot 120 of the metal mechanism element 110, so as to achieve the waterproof or dustproof functions.

The feeding radiation element 130, the first radiation element 140, the second radiation element 150 are made of metal materials, such as copper, silver, aluminum, iron, or their alloys. The dielectric substrate 170 may be an FR4 (Flame Retardant 4) substrate, a PCB (Printed Circuit Board), or an FCB (Flexible Circuit Board). The dielectric substrate 170 has a first surface E1 and a second surface E2 which are opposite each other. The feeding radiation element 130, the first radiation element 140, and the second radiation element 150 are disposed on the first surface E1 of the dielectric substrate 170. The second surface E2 of the dielectric substrate 170 is adjacent to the metal mechanism element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the second surface E2 of the dielectric substrate 170 is directly attached to the metal mechanism element 110, and thus the dielectric substrate 170 at least partially overlaps the slot 120 of the metal mechanism element 110.

A ground voltage VSS of the mobile device 100 may be provided by a ground element (not shown). The ground element may be coupled to the metal mechanism element 110. For example, the ground element may be a ground copper foil which extends from the dielectric substrate 170 onto the metal mechanism element 110.

The feeding radiation element 130 may substantially have a straight-line shape. The feeding radiation element 130 has a first end 131 and a second end 132. A feeding point FP is positioned at the first end 131 of the feeding radiation element 130. The feeding point FP may be further coupled to a signal source 190. For example, the signal source 190 may be an RF (Radio Frequency) module for exciting an antenna structure of the mobile device 100. In some embodiments, the feeding radiation element 130 has a vertical projection on the metal mechanism element 110, and the vertical projection of the feeding radiation element 130 is adjacent to the closed end 122 of the slot 120. In alternative embodiments, the vertical projection of the feeding radiation element 130 can cover the closed end 122 of the slot 120.

The first radiation element 140 may substantially have an L-shape, and it may be partially parallel to the feeding radiation element 130 and partially perpendicular to the feeding radiation element 130. The first radiation element 140 extends across the slot 120 of the metal mechanism element 110. That is, the first radiation element 140 has a vertical projection on the metal mechanism element 110, and the vertical projection of the first radiation element 140 at least partially overlaps the slot 120 of the metal mechanism element 110. Specifically, the first radiation element 140 has a first end 141 and a second end 142. The first end 141 of the first radiation element 140 is coupled to the ground voltage VSS. The second end 142 of the first radiation element 140 is coupled to the second end 132 of the feeding radiation element 130. Thus, the feeding radiation element 130 is coupled through the first radiation element 140 to the ground voltage VSS.

The second radiation element 150 may substantially have a straight-line shape or a rectangular shape. Specifically, the second radiation element 150 has a first end 151 and a second end 152. The first end 151 of the second radiation element 150 is coupled to the second end 132 of the feeding radiation element 130. The second end 152 of the second radiation element 150 is an open end, which extends away from the feeding radiation element 130 and the first radiation element 140.

In preferred embodiment, an antenna structure of the mobile device 100 is formed by the feeding radiation element 130, the first radiation element 140, the second radiation element 150, and the slot 120 of the metal mechanism element 110. The slot 120 of the metal mechanism element 110 is excited by the feeding radiation element 130 and the first radiation element 140 using a coupling mechanism.

Figure 5:
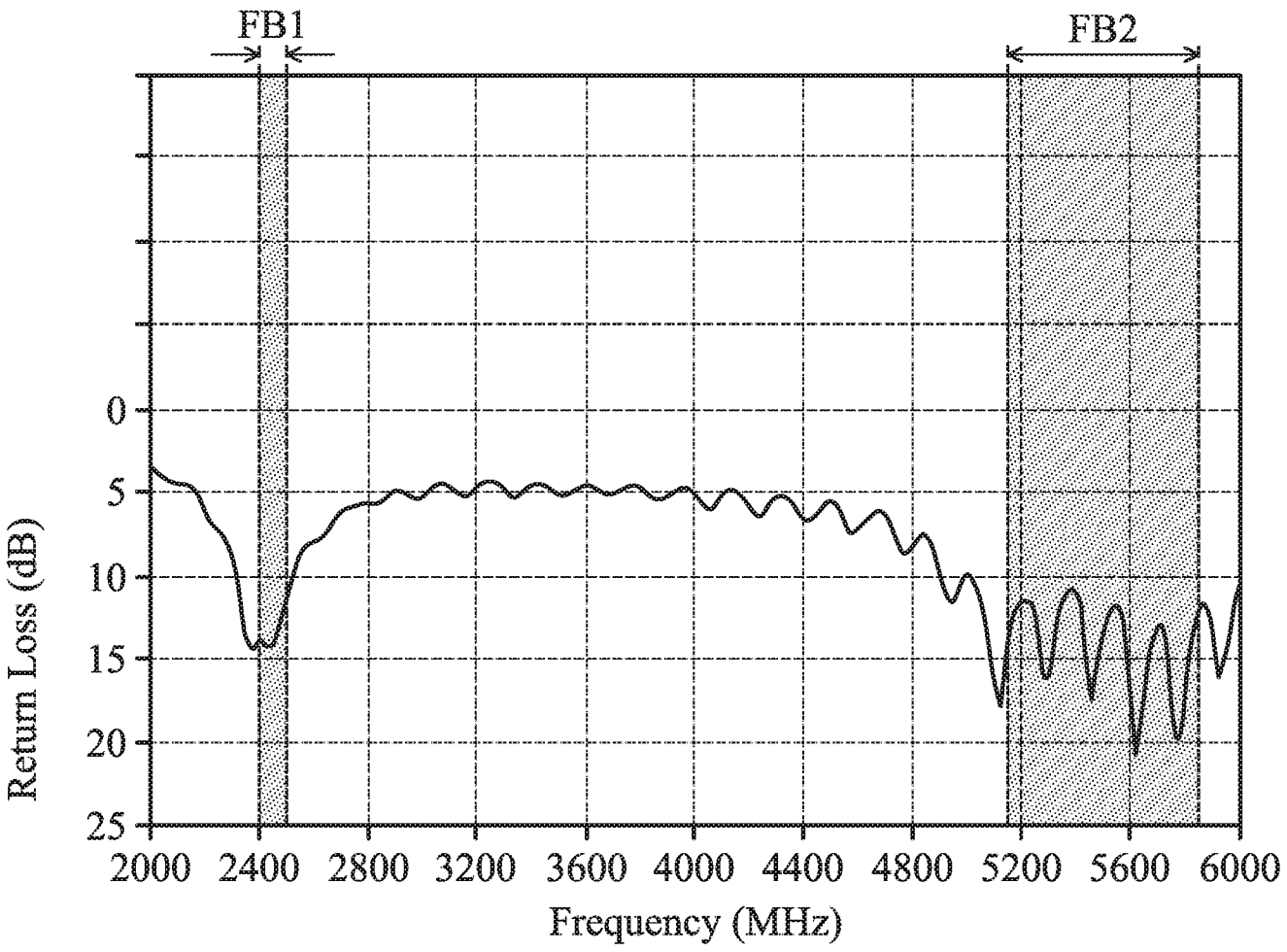
FIG. 5 is a diagram of return loss of an antenna structure of a mobile device according to an embodiment of the invention.

FIG. 5 is a diagram of return loss of the antenna structure of the mobile device 100 according to an embodiment of the invention. The horizontal axis represents the operation frequency (MHz), and the vertical axis represents the return loss (dB). According to the measurement of FIG. 5, when being excited by the signal source 190, the antenna structure of the mobile device 100 can cover a first frequency band FB1 and a second frequency band FB2. The first frequency band FB1 may be from 2400 MHz to 2500 MHz. The second frequency band FB2 may be from 5150 MHz to 5850 MHz. Therefore, the antenna structure of the mobile device 100 can support at least the wideband operations of WLAN (Wireless Local Area Networks) 2.4 GHz/5 GHz.

With respect to the operation principles of the antenna structure, the feeding radiation element 130, the first radiation element 140, the second radiation element 150, and the slot 120 of the metal mechanism element 110 are excited together to generate a fundamental resonant mode, thereby forming the aforementioned first frequency band FB1. In addition, the feeding radiation element 130, the first radiation element 140, the second radiation element 150, and the slot 120 of the metal mechanism element 110 are excited together to further generate a higher-order resonant mode (double-frequency effect), thereby forming the aforementioned second frequency band FB2. The second radiation element 150 is used to fine-tune the impedance matching of the second frequency band FB2 and increase the operation bandwidth of the second frequency band FB2.

Figure 6:
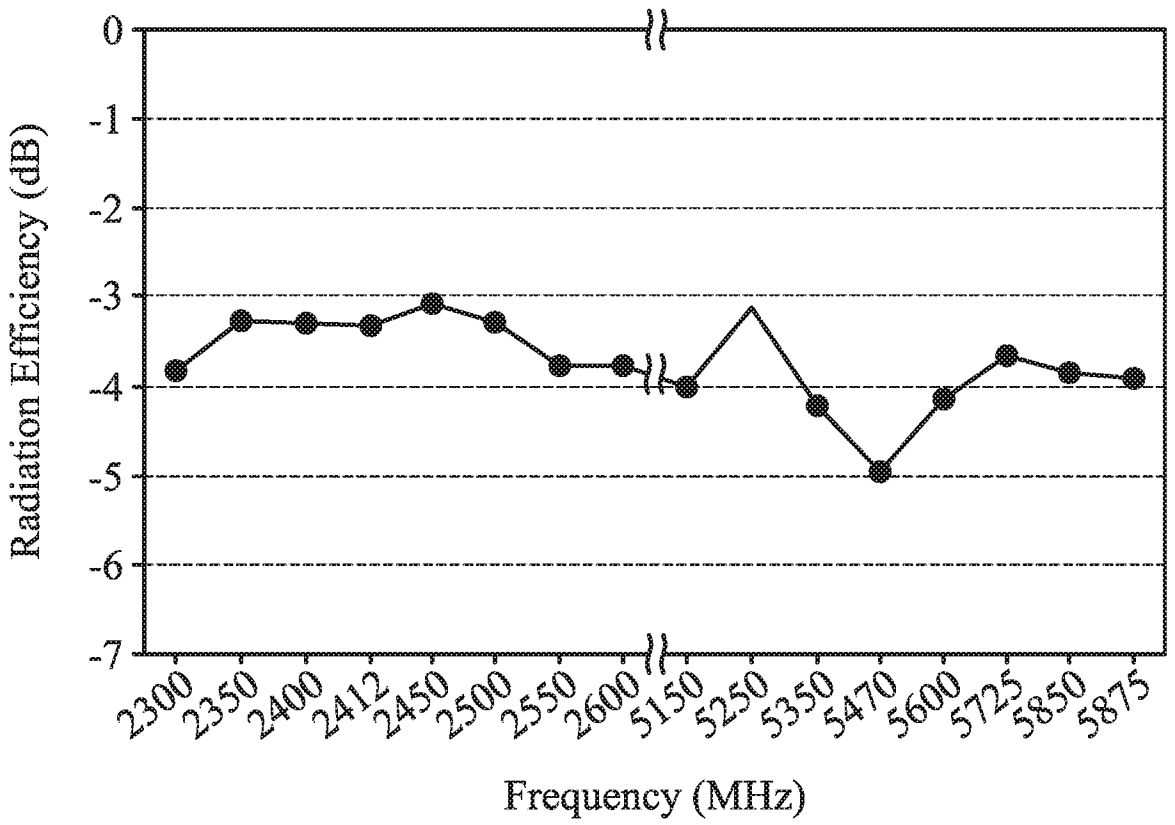
FIG. 6 is a diagram of radiation efficiency of an antenna structure of a mobile device according to an embodiment of the invention.

FIG. 6 is a diagram of radiation efficiency of the antenna structure of the mobile device 100 according to an embodiment of the invention. The horizontal axis represents the operation frequency (MHz), and the vertical axis represents the radiation efficiency (dB). According to the measurement of FIG. 6, the radiation efficiency of the antenna structure of the mobile device 100 can reach −4 dB or higher within the first frequency band FB1 and the second frequency band FB2, and it can meet the requirement of practical application of general WLAN communication.

In some embodiments, the element sizes of the mobile device 100 are described as follows. The length LS of the slot 120 of the metal mechanism element 110 (i.e., the length from the open end 121 to the closed end 122) may be substantially equal to 0.25 wavelength (λ/4) of the first frequency band FB1 of the antenna structure of the mobile device 100. The width WS of the slot 120 of the metal mechanism element 110 may be from 2 mm to 3 mm. The total length of the feeding radiation element 130 and the first radiation element 140 (i.e., the total length from the first end 131 through the second end 142 to the first end 141) may be from 8 mm to 12 mm, such as 10 mm. The length of the second radiation element 150 (i.e., the length from the first end 151 to the second end 152) may be from 2 mm to 4 mm, such as 3 mm. A first distance D1 is defined between the first radiation element 140 and the open end 121 of the slot 120. A second distance D2 is defined between the first radiation element 140 and the closed end 122 of the slot 120. The ratio of the second distance D2 to the first distance D1 (i.e., D2/D1) may be from 3 to 4. The first distance D1 may be from 4 mm to 6 mm, such as 5 mm. The height H1 of the antenna structure of the mobile device 100 may be shorter than or equal to 6 mm. The ranges of the above element sizes are calculated and obtained according to many experiment results, and they help to optimize the operation bandwidth and impedance matching of the antenna structure of the mobile device 100.

The invention proposes a novel mobile device and a novel antenna structure, which may be integrated with a metal mechanism element. Since the metal mechanism element is considered as an extension portion of the antenna structure, it does not negatively affect the radiation performance of the antenna structure. According to practical measurements, the capacitive characteristic of the antenna structure is enhanced and the height of the antenna structure is minimized by using a loop-like feeding mechanism to excite the slot of the metal mechanism element. In comparison to the conventional design, the invention has the advantages of small size, wide bandwidth, low profile, and beautiful device appearance, and therefore it is suitable for application in a variety of mobile communication devices (especially for those with narrow borders).

Note that the above element sizes, element shapes, and frequency ranges are not limitations of the invention. An antenna designer can fine-tune these settings or values according to different requirements. It should be understood that the mobile device of the invention is not limited to the configurations of FIGS. 1-6. The invention may merely include any one or more features of any one or more embodiments of FIGS. 1-6. In other words, not all of the features displayed in the figures should be implemented in the mobile device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal mechanism element, having a slot, wherein the slot has an open end and a closed end;

a feeding radiation element, having a feeding point;

a first radiation element, extending across the slot of the metal mechanism element, wherein the feeding radiation element is coupled through the first radiation element to a ground voltage;

a second radiation element, coupled to the feeding radiation element; and a dielectric substrate, disposed adjacent to the metal mechanism element, wherein the feeding radiation element, the first radiation element, and the second radiation element are disposed on the dielectric substrate;

wherein an antenna structure is formed by the feeding radiation element, the first radiation element, the second radiation element, and the slot of the metal mechanism element;

wherein the feeding radiation element has a first end and a second end, and the feeding point is positioned at the first end of the feeding radiation element;

wherein the first radiation element has a first end and a second end, the first end of the first radiation element is coupled to the ground voltage, and the second end of the first radiation element is coupled to the second end of the feeding radiation element.

2. The mobile device as claimed in claim 1, wherein the feeding radiation element substantially has a straight-line shape.

3. The mobile device as claimed in claim 1, wherein the first radiation element substantially has an L-shape.

4. The mobile device as claimed in claim 1, wherein the second radiation element substantially has a straight-line shape.

5. The mobile device as claimed in claim 1, wherein the second radiation element has a first end and a second end, the first end of the second radiation element is coupled to the second end of the feeding radiation element, and the second end of the second radiation element is an open end.

6. The mobile device as claimed in claim 1, wherein the antenna structure covers a first frequency band and a second frequency band, the first frequency band is from 2400 MHz to 2500 MHz, and the second frequency band is from 5150 MHz to 5850 MHz.

7. The mobile device as claimed in claim 6, wherein a length of the slot is substantially equal to 0.25 wavelength of the first frequency band.

8. The mobile device as claimed in claim 1, wherein a height of the antenna structure is shorter than or equal to 6 mm.

9. The mobile device as claimed in claim 1, wherein a width of the slot is from 2 mm to 3 mm.

10. The mobile device as claimed in claim 1, wherein a total length of the feeding radiation element and the first radiation element is from 8 mm to 12 mm.

11. The mobile device as claimed in claim 1, wherein a length of the second radiation element is from 2 mm to 4 mm.

12. The mobile device as claimed in claim 1, wherein a first distance is defined between the first radiation element and the open end of the slot, a second distance is defined between the first radiation element and the closed end of the slot, and a ratio of the second distance to the first distance is from 3 to 4.

13. The mobile device as claimed in claim 12, wherein the first distance is from 4 mm to 6 mm.

14. A mobile device, comprising:

a metal mechanism element, having a slot, wherein the slot has an open end and a closed end;

a feeding radiation element, having a feeding point;

a first radiation element, extending across the slot of the metal mechanism element, wherein the feeding radiation element is coupled through the first radiation element to a ground voltage;

a second radiation element, coupled to the feeding radiation element; and a dielectric substrate, disposed adjacent to the metal mechanism element, wherein the feeding radiation element, the first radiation element, and the second radiation element are disposed on the dielectric substrate;

wherein an antenna structure is formed by the feeding radiation element, the first radiation element, the second radiation element, and the slot of the metal mechanism element;

wherein the feeding radiation element has a first end and a second end, and the feeding point is positioned at the first end of the feeding radiation element;

wherein the second radiation element has a first end and a second end, the first end of the second radiation element is coupled to the second end of the feeding radiation element, and the second end of the second radiation element is an open end.

15. A mobile device, comprising:

a metal mechanism element, having a slot, wherein the slot has an open end and a closed end;

a feeding radiation element, having a feeding point;

a first radiation element, extending across the slot of the metal mechanism element, wherein the feeding radiation element is coupled through the first radiation element to a ground voltage;

a second radiation element, coupled to the feeding radiation element; and a dielectric substrate, disposed adjacent to the metal mechanism element, wherein the feeding radiation element, the first radiation element, and the second radiation element are disposed on the dielectric substrate;

wherein an antenna structure is formed by the feeding radiation element, the first radiation element, the second radiation element, and the slot of the metal mechanism element;

wherein a length of the second radiation element is from 2 mm to 4 mm.

* * * * *